US006645306B2

(12) United States Patent
Madi et al.

(10) Patent No.: US 6,645,306 B2
(45) Date of Patent: Nov. 11, 2003

(54) HYDROGEN PEROXIDE PICKLING SCHEME FOR STAINLESS STEEL GRADES

(75) Inventors: Vijay N. Madi, Fairfield, OH (US); Jerald W. Leeker, Trenton, OH (US); Clayton A. Van Scoy, Butler, PA (US)

(73) Assignee: AK Steel Corporation, Middletown, OH (US)

( * ) Notice: Subject to any disclaimer, the term of this patent is extended or adjusted under 35 U.S.C. 154(b) by 0 days.

(21) Appl. No.: 10/118,765

(22) Filed: Apr. 9, 2002

(65) Prior Publication Data

US 2002/0174880 A1 Nov. 28, 2002

Related U.S. Application Data

(60) Provisional application No. 60/282,565, filed on Apr. 9, 2001.

(51) Int. Cl.[7] ..... C23G 1/02

(52) U.S. Cl. ..... 134/3; 134/2; 134/9; 134/15; 134/19; 134/25.5; 134/26; 134/28; 134/30; 134/34; 134/35; 134/36; 134/41; 134/42; 510/258; 510/367; 252/186.27; 252/186.28; 252/186.41

(58) Field of Search ..... 148/713; 134/2, 134/3, 9, 15, 19, 25.5, 26, 28, 30, 34, 35, 36, 41, 42; 510/258, 367; 252/186.27, 186.28, 186.41

(56) References Cited

U.S. PATENT DOCUMENTS

| | | | | | |
|---|---|---|---|---|---|
| 2,347,742 | A | * | 5/1944 | Keene et al. | 205/713 |
| 3,489,652 | A | | 1/1970 | Dell et al. | 156/8 |
| 3,649,194 | A | | 3/1972 | Glanville | 23/207.5 |
| 3,864,271 | A | | 2/1975 | Stalter | 252/99 |
| 3,903,244 | A | | 9/1975 | Winkley | 423/272 |
| 3,905,907 | A | | 9/1975 | Shiga | 252/79.4 |
| 4,002,489 | A | * | 1/1977 | Hedqvist et al. | 134/28 |
| 4,022,703 | A | | 5/1977 | Bakes et al. | 252/100 |
| 4,051,057 | A | | 9/1977 | Ericson et al. | 252/100 |
| 4,459,216 | A | | 7/1984 | Nakazato et al. | 252/79.4 |
| 4,754,803 | A | | 7/1988 | Escobar, Jr. et al. | 164/452 |
| 4,946,520 | A | | 8/1990 | Escobar, Jr. et al. | 148/432 |
| 5,100,500 | A | | 3/1992 | Dastolfo | 216/252 |
| 5,154,774 | A | | 10/1992 | Bousquet et al. | |
| 5,164,016 | A | | 11/1992 | Henriet | 134/3 |
| 5,248,386 | A | | 9/1993 | Dastolfo, Jr. et al. | 134/2 |
| 5,292,374 | A | | 3/1994 | Maresch et al. | 156/659.1 |
| 5,354,383 | A | | 10/1994 | Bianchi | 134/3 |
| 5,417,775 | A | | 5/1995 | Pedrazzini | 134/3 |
| 5,538,152 | A | | 7/1996 | Fontana | 216/269 |
| 5,702,534 | A | | 12/1997 | Rodabaugh et al. | 134/7 |
| 5,743,968 | A | | 4/1998 | Leeker et al. | 134/2 |
| 5,785,765 | A | | 7/1998 | Zavattoni | 134/2 |
| 5,810,939 | A | * | 9/1998 | Angel et al. | 134/2 |
| 5,821,212 | A | | 10/1998 | Peterson | 510/258 |
| 5,843,240 | A | | 12/1998 | Pedrazzini et al. | 134/3 |
| 5,904,157 | A | | 5/1999 | Meseha et al. | 134/3 |
| 5,908,511 | A | | 6/1999 | Bianchi | 134/3 |
| 5,958,147 | A | | 9/1999 | Berglind et al. | 134/3 |

(List continued on next page.)

FOREIGN PATENT DOCUMENTS

| | | | | |
|---|---|---|---|---|
| EP | 582121 | | 2/1994 | |
| GB | 910356 | * | 11/1962 | |
| JP | 55018552 A | * | 2/1980 | C23G/1/08 |
| JP | 55050468 A | * | 4/1980 | C23C/15/00 |
| JP | 61049706 A | * | 3/1986 | B21B/3/02 |
| JP | A-2122087 | | 5/1990 | |
| JP | 11269677 A | * | 10/1999 | C23G/1/08 |
| WO | WO 02/081777 A1 | * | 10/2002 | |

*Primary Examiner*—Sharidan Carrillo
(74) *Attorney, Agent, or Firm*—Frost Brown Todd LLC

(57) ABSTRACT

The present invention relates to a process for pickling hot rolled, hot rolled & annealed, and cold rolled & annealed stainless steel strip in a continuous fashion. The process comprises a series of pre-pickling tanks and pickling tanks, and optionally includes a scrubber-brush tank, a de-smutting tank, a filtration unit and a heat exchanger.

23 Claims, 3 Drawing Sheets

U.S. PATENT DOCUMENTS 5,992,196 A 11/1999 Giraud et al. ..... 72/39
6,068,001 A 5/2000 Pedrazzini et al. ..... 134/3
6,174,383 B1 1/2001 Angel et al. ..... 134/41
6,210,491 B1 4/2001 Colgan et al. ..... 134/10
6,540,931 B1 * 4/2003 Faw et al. ..... 216/106
2002/0148484 A1 * 10/2002 Cole et al. ..... 134/2
2002/0174880 A1 * 11/2002 Madi et al. ..... 134/3

* cited by examiner

Scheme 1

Scheme 2

Scheme 3

HYDROGEN PEROXIDE PICKLING SCHEME FOR STAINLESS STEEL GRADES

This application is based on and claims priority from U.S. provisional Patent Application Serial No. 60/282,565, Vijay N. Madi, Jerald W. Leeker, Clayton A. Van Scoy, filed Apr. 9, 2001.

FIELD OF INVENTION

This invention relates to a process for pickling ferrous alloy steels (stainless steels). More particularly, this invention relates to a process for pickling hot rolled and annealed stainless steel strip using a pickling solution comprising hydrogen peroxide.

BACKGROUND

The annealing of stainless steel strip can result in the formation of oxides on the surface of the steel. These oxides, comprised of iron, chromium, nickel and other associated metal oxides, must be removed prior to utilizing the steel. However, the oxides of stainless steel are resistant to most of the common acid treatments. These oxides adhere tightly to the base metal, thus requiring mechanical scale cracking such as shot blasting, roll bending or leveling of the steel strip or electrolytic and/or molten salt bath treatment in order to either loosen these oxides or make the surface more porous prior to pickling. Traditionally, the oxides on the surface of the stainless steel have been removed, or "pickled off," using nitric acid in combination with hydrofluoric acid.

There is a desire for a method of pickling stainless steels that eliminates the use of nitric acid.

SUMMARY OF THE INVENTION

The present invention relates to a process for pickling hot rolled, hot rolled & annealed, and cold rolled & annealed stainless steel strip in a continuous fashion. The process comprises immersing the stainless steel strip in a pre-pickling tank comprising a solution of sulfuric acid and hydrofluoric acid. The strip is then immersed in a pickling tank comprising a solution of sulfuric acid, hydrofluoric acid and hydrogen peroxide. In one embodiment, the pre-pickling tank (Tank 1 in FIG. 1) contains from about 90 g/l to about 200 g/l sulfuric acid and from about 10 g/l to about 60 g/l hydrofluoric acid. The solution in the pre-pickling tank is maintained at a temperature of from about 54° C. to about 77° C. The pickling tank (Tank 3 in FIG. 1) is comprised of a mixture of stabilized hydrogen peroxide, sulfuric acid, and hydrofluoric acid. In a specific embodiment, the pickling tank (Tank 3 in FIG. 1) is comprised of a mixture of stabilized hydrogen peroxide in a concentration of about 5 g/l to about 50 g/l, sulfuric acid in a concentration of about 20 g/l to about 60 g/l, and hydrofluoric acid in a concentration of about 2 g/l to about 50 g/l. In another embodiment, the concentration of stabilized hydrogen peroxide is from about 20 g/L to about 40 g/L. In a preferred embodiment, the concentration of stabilized hydrogen peroxide is from about 25 g/L to about 35 g/L. In another embodiment, the concentration of hydrogen peroxide is from about 5 g/L to less than 10 g/L. The solution in the pickling tank is maintained at a temperature of from about 20° C. to about 60° C. and is preferably at a temperature of from about 35 ° C. to about 50° C.

Prior to immersing the steel strip in the pickling tank, the strip may be scrubbed, preferably using a scrubber-brush machine. In addition, the strip may also be immersed in a de-smutting tank immediately prior to being scrubbed. The de-smutting tank contains a solution comprising hydrogen peroxide, sulfuric acid and hydrofluoric acid, which is the overflow pickle solution form the pickling tank that is channeled back into the de-smutting tank.

In a separate embodiment, a filtration device and a heat exchanger are external to and coupled to the pickling tank. The filtration system device and heat exchanger are arranged in a re-circulating loop so that at any time, a portion of the solution from the pickling tank is routed through the filtration system device and heat exchanger. The resulting solution is deposited back into the pickling tank through at least one nozzle located inside the pickling tank.

DESCRIPTION OF INVENTION

The present invention relates to a process for pickling hot rolled, hot rolled & annealed, and cold rolled & annealed stainless steel strip in a continuous fashion. The process comprises at least one pre-pickling tank and at least one pickling tank, and optionally includes a scrubber-brush tank, a de-smutting tank, a filtration unit and a heat exchanger. In the basic scheme (see FIG. 1), the steel strip is first immersed into at least one pre-pickling tank (Tank 1 in FIG. 1). The solution contained in the pre-pickling tank (Tank 1 in FIG. 1) is comprised of a mixture of sulfuric acid and hydrofluoric acid. In one embodiment, the sulfuric acid is in a concentration of from about 90 g/l to about 200 g/l and hydrofluoric acid, in a concentration of about 10 g/l to about 60 g/l. This solution is maintained at an elevated temperature of about 54° C. to about 77° C. The pickling tank (Tank 3 in FIG. 1) is comprised of a mixture of stabilized hydrogen peroxide, sulfuric acid, and hydrofluoric acid. In a specific embodiment, the pickling tank (Tank 3 in FIG. 1) is comprised of a mixture of stabilized hydrogen peroxide in a concentration of about 5 g/l to about 50 g/l, sulfuric acid in a concentration of about 20 g/l to about 60 g/l, and hydrofluoric acid in a concentration of about 2 g/l to about 50 g/l. In another embodiment, the concentration of stabilized hydrogen peroxide is from about 20 g/L to about 40 g/L. In a preferred embodiment, the concentration of stabilized hydrogen peroxide is from about 25 g/L to about 35 g/L. In another embodiment, the concentration of hydrogen peroxide is from about 5 g/L to less than 10 g/L. This pickling tank is maintained at a temperature of about 20° C. to about 60° C., with a preferred temperature range of about 35 ° C. to about 50° C.

Figure 1:
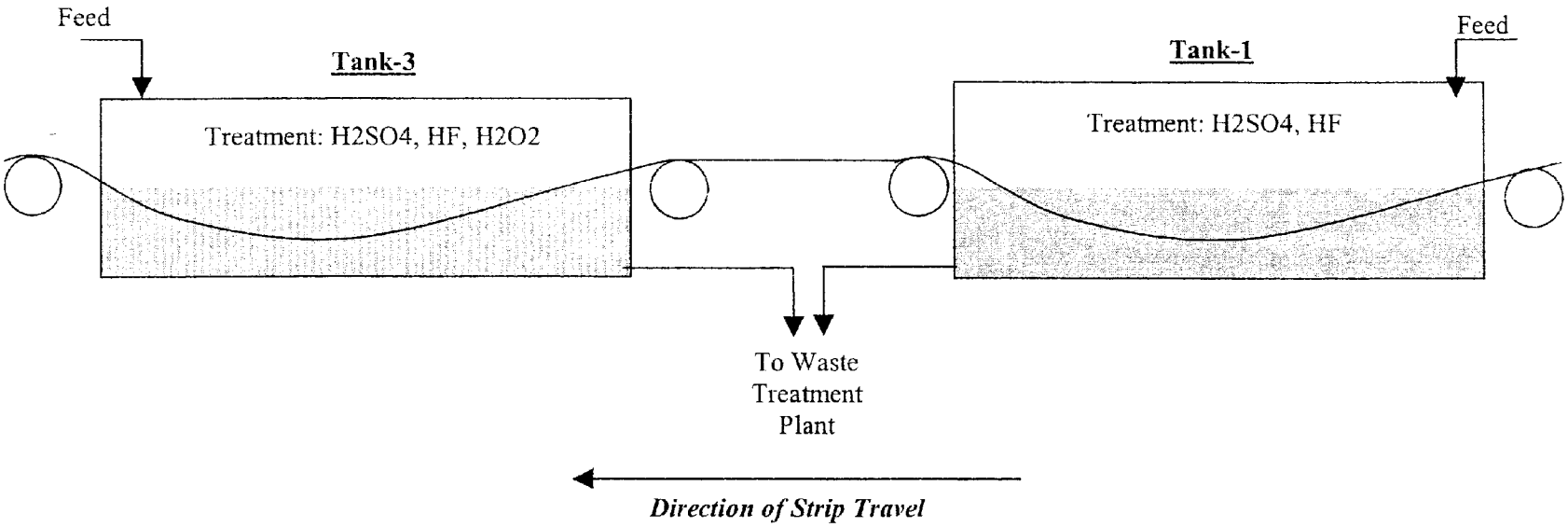
FIG. 1: Scheme 1: Basic two-tank scheme for hydrogen peroxide pickling of stainless steel.
Figure 2:
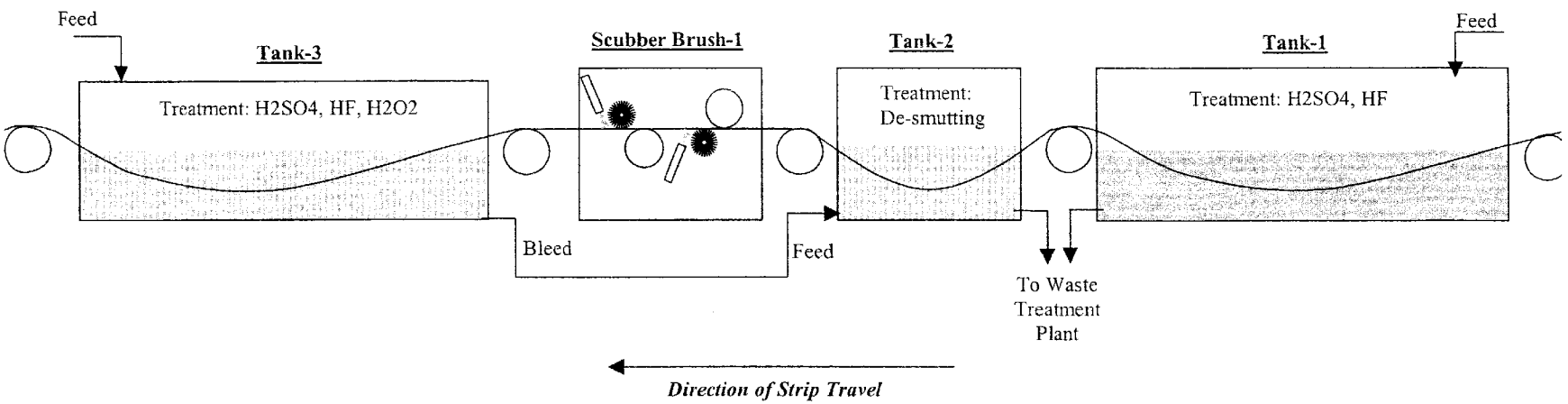
FIG. 2: Scheme 2: Scheme for hydrogen peroxide pickling of stainless steel with intermediate treatment of a de-smutting tank followed by a scrubber-brush machine.

In addition to the embodiment shown for the basic pickling process in FIG. 1, further optional steps may also be added to this pickling process. One embodiment includes the addition of a scrubber-brush tank and a de-smutting tank to the pickling process. The scrubber-brush tank serves to mechanically remove, at least in part, oxides (scale) from the stainless steel strip. The de-smutting tank (Tank 2 in FIG. 2) receives the pickle solution overflow from Tank 3. In the de-smutting tank, oxide on the steel strip, received from Tank 1 can start to react with the hydrogen peroxide-containing pickle solution. The subsequent scrubber-brush step (Scrubber Brush-1 in FIG. 2) mechanically removes the oxide from the strip surface. These additional steps prevent much of the oxide from entering Tank 3.

Figure 3:
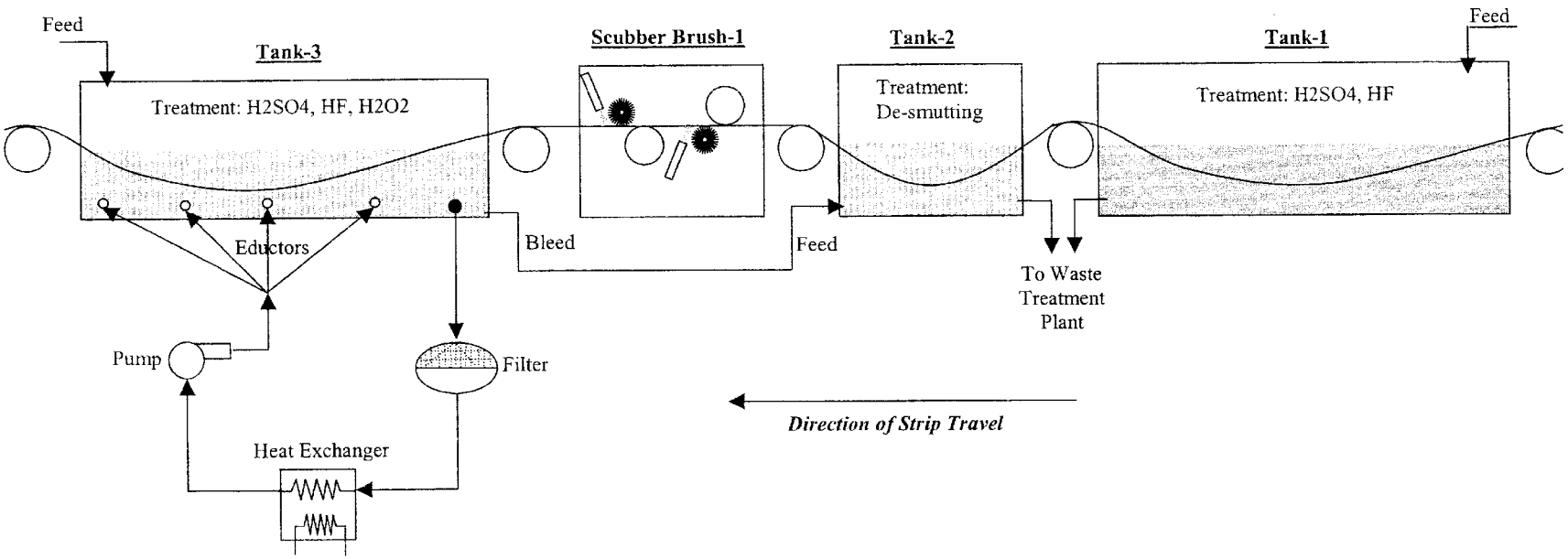
FIG. 3: Scheme 3: Scheme for hydrogen peroxide pickling of stainless steel with intermediate treatment of a de-smutting tank followed by a scrubber-brush apparatus and where Tank 3 is equipped with a filtration unit and heat exchanger.

A further embodiment of the basic pickling process is shown in FIG. 3. The pickling process in Tank 3 is an exothermic reaction. The heat produced by the pickling process may be due in part to the reaction of loose oxide particles in the tank with the pickling solution. Accordingly, in order to minimize the rise in temperature and degradation of hydrogen peroxide in Tank 3, it is desirable to keep the loose oxide particles out of the pickling tank and control the tank temperature to below 54° C. and preferably below 43° C.

This is accomplished by the use of a filtration device and a heat exchanger which are coupled to Tank 3. The filtration system and heat exchanger are arranged in a re-circulating loop so that at any time, a portion of the pickling solution from Tank 3 is routed through the filtration system and heat exchanger and the resulting pickling solution is distributed back into the pickling tank (Tank 3) through at least one nozzle (shown as eductors in FIG. 3).

EXAMPLES

Example 1

The following hot rolled stainless steels are processed on a continuous anneal pickle line. Before pickling as per the conditions below, the steel is annealed at proper temperature depending on the alloy and then mechanically de-scaled using a steel shot blasting device. The steel strip surface is also subjected to scrubbing after Tank 1. This process produces steel at quality of at production rates comparable to pickling systems that use nitric acid.

| | TANK-1 (Pre-Pickling Treatment) | | | TANK-3 (Final Treatment) | | | |
|---|---|---|---|---|---|---|---|
| Stainless Steel Type | $H_2SO_4$ g/l | HF g/l | Temp. Deg. C. | $H_2SO_4$ g/l | HF g/l | $H_2O_2$ g/l | Temp. Deg. C. |
| Hot Rolled 304 | 170 | 50 | 77 | 60 | 30 | 30 | 49 |
| Hot Rolled 409 | 147 | 33 | 76 | 24 | 7 | 37 | 38 |

Example 2

The following cold rolled stainless steels are processed on a continuous anneal pickle line. Before pickling as per the conditions below, the steel is annealed at a proper temperature depending on the alloy and then its oxide is conditioned by treating it in a molten salt bath. The strip is also subjected to intermediate de-smutting treatment in Tank-2. The strip surface is also scrubbed with brushes after the de-smutting step. The pickling solution in Tank-3 is also subjected to temperature control by a heat exchanger and filtration. The process produces commercially acceptable quality steel at production rates comparable to pickling systems that use nitric acid.

| | TANK-1 (Pre-Pickling Treatment) | | | TANK-3 (Final Treatment) | | | |
|---|---|---|---|---|---|---|---|
| Stainless Steel Type | $H_2SO_4$ g/l | HF g/l | Temp. Deg. C. | $H_2SO_4$ g/l | HF g/l | $H_2O_2$ g/l | Temp. Deg. C. |
| Cold Rolled 316 | 90 | 40 | 71 | 45 | 20 | 24 | 41 |
| Cold Rolled 409 | 90 | 40 | 71 | 45 | 4 | 27 | 35 |
| Cold Rolled 439 | 90 | 40 | 71 | 45 | 35 | 25 | 46 |

What is claimed is:

1. A process for pickling stainless steel strip in a continuous fashion comprising the steps of:

a. heating a pre-pickling tank, said pre-pickling tank containing an aqueous pre-pickling solution consisting of sulfuric acid and hydrofluoric acid and immersing said strip in said pre-pickling tank;

b. immersing said strip in a pickling tank after step a, said pickling tank containing an aqueous pickling solution consisting of sulfuric acid, hydrofluoric acid and stabilized hydrogen peroxide; and c. removing heat from the pickling solution of step b.

2. The process of claim 1 wherein a heat exchanger is external to and coupled to said pickling tank, and the heat exchanger is arranged in a re-circulating loop so that at any time, a portion of the aqueous pickling solution from said pickling tank is routed through the heat exchanger and the resulting aqueous solution is deposited back into said pickling tank through at least one inlet located inside said pickling tank.

3. The process of claim 1 wherein the concentration of stabilized hydrogen peroxide in said pickling tank is from about 5 g/L to about 50 g/L.

4. The process of claim 1 wherein the concentration of stabilized hydrogen peroxide in said pickling tank is from about 5 g/L to less than 10 g/L.

5. The process of claim 1 wherein said strip is scrubbed after step a, and prior to immersion in said pickling tank.

6. The process of claim 2 wherein said heat exchanger and a filtration device is external to and coupled to the pickling tank.

7. The process of claim 5 wherein said strip is immersed in a de-smutting tank prior to being scrubbed, said de-smutting tank containing an aqueous solution consisting of hydrogen peroxide, sulfuric acid and hydrofluoric acid.

8. The process of claim 7 wherein the aqueous solution in said pre-pickling tank consists of from about 90 g/l to about 200 g/l sulfuric acid and from about 10 g/l to about 60 g/l hydrofluoric acid.

9. The process of claim 7 wherein overview solution from the picking tank is channeled into the de-smutting tank.

10. The process of claim 8 wherein the aqueous solution in the pre-pickling tank is maintained at a temperature of from about 54° C. to about 77° C.

11. The process of claim 10 wherein the sulfuric acid in the pickling tank has a concentration of from about 20 g/l to about 60 g/l and the hydrofluoric acid in the pickling tank has a concentration of from about 2 g/l to about 50 g/l.

12. The process of claim 11 wherein the aqueous solution in the pickling tank is maintained at a temperature of from about 20° C. to about 60° C.

13. The process of claim 12 wherein the aqueous solution in the pickling tank is maintained at a temperature of from about 35° C. to about 50° C.

14. A process for pickling hot rolled and annealed stainless steel strip in a continuous fashion comprising the steps of:

a. heating a pre-pickling tank, said pre-pickling tank containing an aqueous solution consisting of sulfuric acid and hydrofluoric acid, and immersing said strip in said pre-pickling tank; and b. immersing said strip in a pickling tank, after step a, said pickling tank containing an aqueous solution consisting of sulfuric acid, hydrofluoric acid and from about 5 g/l to less than 10 g/l of hydrogen peroxide.

c. removing heat from the pickling solution of step b.

15. The process of claim 14 wherein said strip is scrubbed after step a and prior to immersion in said pickling tank.

16. The process of claim 15 wherein said strip is immersed in a de-smutting tank prior to being scrubbed, said de-smutting tank containing an solution consisting of hydrogen peroxide, sulfuric acid and hydrofluoric acid.

17. The process of claim 16 wherein the aqueous solution in said pre-pickling tank consists of from about 90 g/l to about 200 g/l sulfuric acid and from about 10 g/l to about 60 g/l hydrofluoric acid.

18. The process of claim 17 wherein the aqueous solution in the pre-pickling tank is maintained at a temperature of from about 54° C. to about 77° C.

19. The process of claim 18 wherein the sulfuric acid in the pickling tank has a concentration of from about 20 g/l to about 60 g/l and the hydrofluoric acid in the picking tank has a concentration of from about 2 g/l to about 50 g/l.

20. The process of claim 19 wherein the aqueous solution in the pickling tank is maintained at a temperature of from about 20° C. to about 60° C.

21. The process of claim 20 wherein the aqueous solution in the pickling tank is maintained at a temperature of from about 35° C. to about 50° C.

22. The process of claim 21 wherein overflow solution from the pickling tank is channeled into the de-smutting tank.

23. The process of claim 22 wherein a filtration device and a heat exchanger are external to and coupled to the pickling tank, and the filtration device and heat exchanger are arranged in a re-circulating loop so that at any time, a portion of the aqueous pickling solution from the pickling tank is routed through the filtration device and heat exchanger and the resulting aqueous solution is deposited back into the pickling tank through at least one inlet located inside the pickling tank.

* * * * *

UNITED STATES PATENT AND TRADEMARK OFFICE

CERTIFICATE OF CORRECTION

PATENT NO. : 6,645,306 B2
DATED : November 11, 2003
INVENTOR(S) : Maudi, V.N. et al.

It is certified that error appears in the above-identified patent and that said Letters Patent is hereby corrected as shown below:

Column 2,
Line 8, is corrected as follows: -- The filtration device and … --
Line 11, is corrected as follows: -- tion device and … --
Line 49, is corrected as follows: -- ...about 60 g/l, and hydro- --
Line 50, is corrected as follows: -- fluoric acid in a… --

Signed and Sealed this

Twenty-fourth Day of February, 2004

JON W. DUDAS
*Acting Director of the United States Patent and Trademark Office*